US005197860A

United States Patent [19]

Nishida et al.

[11] Patent Number: 5,197,860

[45] Date of Patent: Mar. 30, 1993

[54] HYDRAULIC APPARATUS FOR CONSTRUCTION MACHINES

[76] Inventors: Kimio Nishida, 23-16, Ikenomiya 2-chome, Hirakata-shi, Osaka-fu 573; Toshio Yokoyama, 53-4, Obiraki, Hirono-cho, Uji-shi, Kyoto-fu 611; Yukio Moriya, 4-1-1-1307, Nishimakino, Hirakata-shi, Osaka-fu 573; Takeshi Kobayashi, 3-28-7, Higashikori, Hirakata-shi, Osaka-fu 573. all of Japan

[21] Appl. No.: 391,557

[22] PCT Filed: Dec. 25, 1987

[86] PCT No.: PCT/JP87/01036

§ 371 Date: Jul. 27, 1989

§ 102(e) Date: Jul. 27, 1989

[87] PCT Pub. No.: WO88/05869

PCT Pub. Date: Aug. 11, 1988

[30] Foreign Application Priority Data

Jan. 30, 1987 [JP] Japan ..... 62-19767

[51] Int. Cl.[5] ..... F04B 49/06

[52] U.S. Cl. ..... 417/34; 417/15; 417/220; 417/221; 417/222.1; 417/316; 60/434

[58] Field of Search ..... 417/34, 15, 222, 218, 417/219, 220, 221, 316, 317; 60/433, 434

[56] References Cited

U.S. PATENT DOCUMENTS

| | | | |
|---|---|---|---|
| 3,937,597 | 2/1976 | Bacquie et al. | 417/15 |
| 4,364,230 | 12/1982 | Holmes | 417/218 |
| 4,395,199 | 7/1983 | Izumi et al. | 417/222 |
| 4,904,161 | 2/1990 | Kamide et al. | 417/34 |

FOREIGN PATENT DOCUMENTS 62-27275 6/1987 Japan .

*Primary Examiner*—Richard A. Bertsch
*Assistant Examiner*—David W. Scheuermann

[57] ABSTRACT

A hydraulic apparatus for a construction machine, which is adapted to prevent the number of revolutions of an engine from increasing when the flow of the fluid discharged by a variable displacement hydraulic pump driven by the engine is cut off. The hydraulic apparatus comprises a proportional solenoid (11) connected to a fuel supply control lever (13) so as to vary the horsepower characteristics of the engine, which are set by the action of a governor (12) based on manipulated variable of the fuel supply control lever (13) when the flow of the fluid discharged by said pump is cut off, and a controller (10) for controlling the proportional solenoid (11). In this apparatus, a decrement ($\Delta Nr$) in a target number of revolutions per minute (Nr) of the engine, which can be obtained by subtracting a target number of revolutions per minute (Nrb) of the engine at the desired engine horsepower characteristics ($l_2$) from a target number of revolutions per minute (Nra) at the initial engine horsepower characteristics ($l_1$) is computed, and said proportional solenoid (11) is operated in accordance with this decrement.

1 Claim, 4 Drawing Sheets

HYDRAULIC APPARATUS FOR CONSTRUCTION MACHINES

TECHNICAL FIELD OF THE INVENTION

This invention relates to a hydraulic apparatus comprising at least one variable displacement hydraulic pump driven by a prime mover such as an engine or the like, and more particularly to a hydraulic apparatus for a construction machine having means for preventing the number of revolutions of the engine from increasing when the flow of the fluid discharged by the hydraulic pump is cut off.

BACKGROUND TECHNIQUES OF THE INVENTION

There has so far been put to practical use a hydraulic apparatus as disclosed in Japanese Laid-Open Patent Application No. SHO 56-80554 wherein a variable displacement pump driven by an engine is controlled in accordance with the equi-horsepower characteristics A as shown in FIG. 4, and the flow Q of the fluid discharged by the pump is cut off in accordance with the cut-off characteristics B as shown in the same drawing, when the delivery pressure P of the pump reaches or exceeds a preset pressure $P_A$.

When the above-mentioned pump is controlled in accordance with the above-mentioned equi-horsepower characteristics A, a fixed horsepower which is input to the pump can be drived therefrom as a force at a time (when P is high and Q is low), or as a speed at a time (when P is low and Q is high).

Further, by cutting off the flow Q of the fluid discharged by the pump, the fluid flow from the pump at the time of relief can be reduced so that the relief losses can be reduced.

Meanwhile, in case of hydraulic apparatuses for construction machines, the above-mentioned hydraulic pump is connected to a plurality of implement driving hydraulic actuators, such as, for example, hydraulic piston cylinder units and hydraulic motors, etc. In this hydraulic apparatus, if one implement conducts a heavy load operation so that the delivery pressure P of the pump reaches or exceeds a preset cut off-pressure $P_A$, then the flow of the fluid discharged by the pump is reduced due to the cut-off so that the pump becomes unable to input the horsepower defined by the equi-horsepower characteristics A.

FIG. 5 illustrates rated horsepower characteristics of an engine, i.e., horsepower characteristics available when the accelerator of the engine is at its full open position. Further, this horsepower characteristics are set by the action of a governor.

If the horsepower input by the pump which is determined by the equi-horsepower characteristics A shown in FIG. 4 is matching with the horsepower developed by the engine at a point $m_1$ as shown in FIG. 5, then a reduction in the horsepower input by the pump due to the above-mentioned cut-off results in the point where the horsepower input by the pump matches with the horsepower developed by the engine will move to a point $m_2$, for example.

As is apparent from FIG. 5, with the reduction in the horsepower developed by the engine from the point $m_1$ to the point $m_2$, the number of revolutions of the engine will also change from $N_1$ to $N_2$, the change in the number of revolutions of the engine bringing about the following disadvantage.

Stating in brief, because the number of revolutions of the engine will increase in spite of the fact that a heavy load operation is carried out by an implement, the operator will have a feeling of disorder as if the loading on the engine were reduced, thus lowering the operational efficiency or overloading the engine or other machines thereby involving a risk.

SUMMARY OF THE INVENTION

The present invention has been made in view of the above-mentioned situation in the prior art hydraulic apparatuses, and for its object to provide a hydraulic apparatus for a construction machine adapted to prevent the number of revolutions of the engine from increasing when the flow of the fluid discharged by a hydraulic pump is cut off.

To achieve the above-mentioned object, according to the present invention, there is provided a hydraulic apparatus for a construction machine wherein at least one variable displacement hydraulic pump driven by an engine is controlled in accordance with equi-horsepower characteristics and when the delivery pressure of the pump reaches or exceeds a preset value, the flow of the fluid discharged by the pump is cut off, characterized in that it comprises means for preventing the number of revolutions of the engine from increasing when the flow of the fluid discharged by the pump is cut off.

Further, according to the present invention, there is provided a hydraulic apparatus for a construction machine, characterized in that the means for preventing the number of revolutions of the engine from increasing when the flow of the fluid discharged by the pump is cut off comprises a proportional solenoid connected to a fuel supply control lever of a governor so as to vary the horsepower characteristics of the engine, which are set by the action of the governor based on manipulated variable of the fuel supply control lever, and a controller for controlling the proportional solenoid, the arrangement is made such that when the flow of the fluid discharged by the pump is cut off, the controller functions to compute a decrement in a target number of revolutions per minute of the engine, which is obtained by subtracting a target number of revolutions per minute of the engine at desired engine horsepower characteristics from a target number of revolutions per minute of the engine at the initial engine horsepower characteristics, and the proportional solenoid is operated in accordance with this decrement.

The above-mentioned and other advantages, aspects and objects of the present invention will now be apparent to those skilled in the art upon making reference to the foregoing description and accompanying drawings in which preferred embodiments incorporating the principle of the present invention are shown by example only.

DETAILED DESCRIPTION OF PREFERRED EMBODIMENT

The present invention will now be described by way of example with reference to the accompanying drawings.

Figure 1:
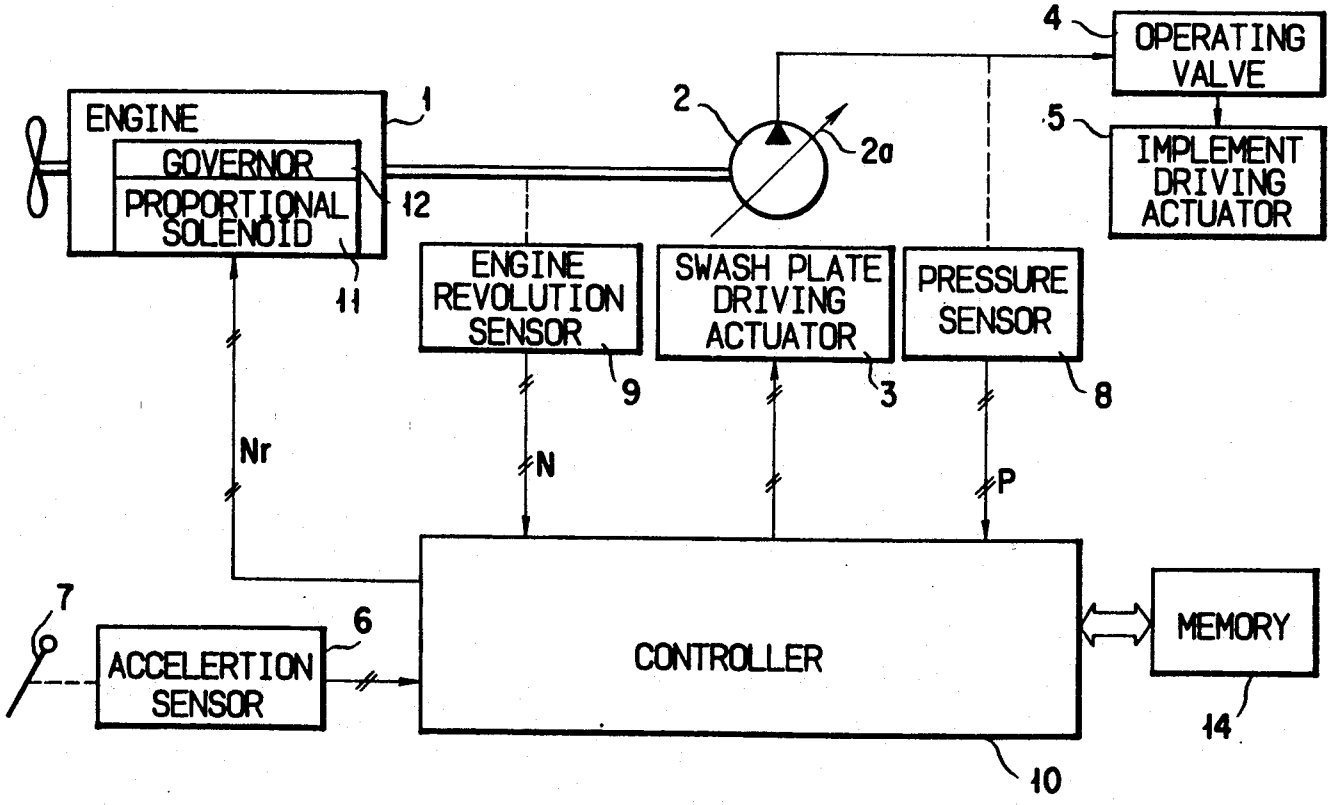
FIG. 1 is a block diagram showing one example of the hydraulic apparatus according to the present invention.

A variable displacement hydraulic pump 2 shown in FIG. 1 is driven by an engine 1, and comprises a swash plate 2a whose angle of tilt is varied by a swash plate driving actuator 3 which consist of a servo valve and hydraulic cylinders, etc. And, this pump 2 is connected by way of an operating valve 4 to an implement driving actuator 5 (such as a hydraulic piston cylinder unit and a hydraulic motor, etc.) of a machine connected thereto.

An acceleration sensor 6 is adapted to transmit an output signal corresponding to manipulated variable of an accelerator lever 7; a pressure sensor 8 is adapted to transmit an output signal indicative of the delivery pressure P of the pump 2; and an engine revolution sensor 9 is adapted to transmit an output signal indicative of the number of revolutions N of the engine 1.

The signal which is output by the above-mentioned acceleration sensor 6 is subjected to processing such as amplification by the controller 10 so as to generate a signal indicative of a target number of revolutions Nr of the engine, which will be input to the proportional solenoid 11.

Figure 2:
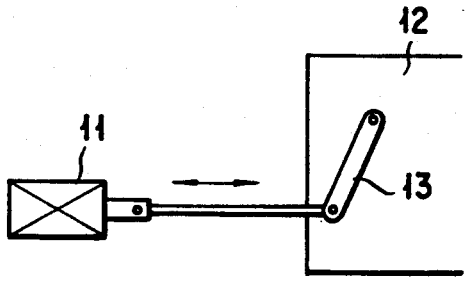
FIG. 2 is a conceptional view showing the location and manner of a proportional solenoid relative to a fuel supply control lever.

As shown in FIG. 2, the proportional solenoid 11 is provided as an actuator for driving a fuel supply control lever 13 of a governor 12. The number of revolutions of the engine 2 is varied by a displacement of the fuel supply control lever 13 which is caused by the energizing force of the proportional solenoid 11.

A memory 14 is adapted to store the equi-horsepower characteristics A and the cut-off characteristics B.

Figure 4:
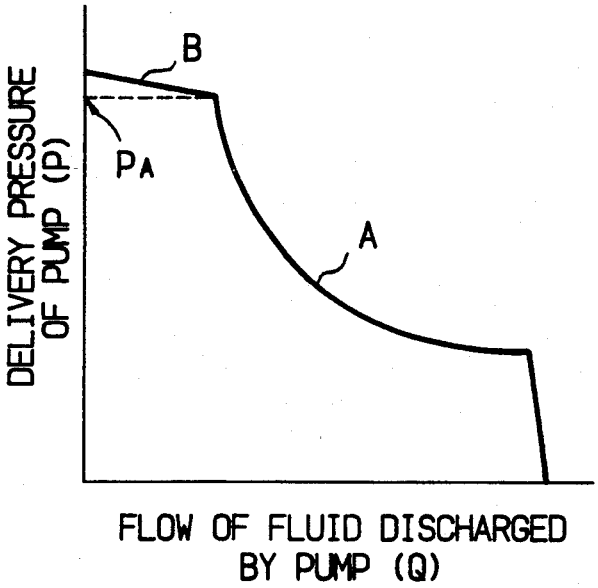
FIG. 4 shows graphs illustrative of the equi-horsepower characteristics of the pump and the cut-off characteristics thereof.

The above-mentioned controller 10 serves to read-out from the memory 14 the flow-rate Q of the fluid discharged by the pump 2 corresponding to the delivery pressure of the pump 2 on the basis of the delivery pressure P detected by the pressure sensor 8 and also the relationship as shown in FIG. 4 which is stored in the memory 14, generate a command signal indicative of an angle of tilt of the swash plate required to obtain this flow-rate Q, and send it to the swash plate driving actuator 3.

That is to say; there is the following relationship between the flow of the fluid discharged by the pump, the number of revolutions of the engine, and the flow of the fluid discharged by the pump per one revolution thereof.

$$Q=K\cdot N\cdot V \quad (1)$$

wherein,

K:constant

V:flow of fluid discharged by the pump per one revolution

Therefore, the value of V can be obtained on the basis of the value of Q which is read out from the memory 14 and the number of revolutions N of the engine And, since the angle of tilt of the swash plate is determined by V, a command indicative of an angle of tilt of the swash plate required to obtain the value of V is output by the controller 10.

As a result, the swash plate 2a of the pump 2 is controlled so that it can be tilted by an angle of tilt corresponding to the above-mentioned command so that until the delivery pressure P reaches a preset cut-off pressure $P_A$ the pump 2 is driven in accordance with the equi-horsepower characteristics. ($P\times Q=$constant).

Figure 5:
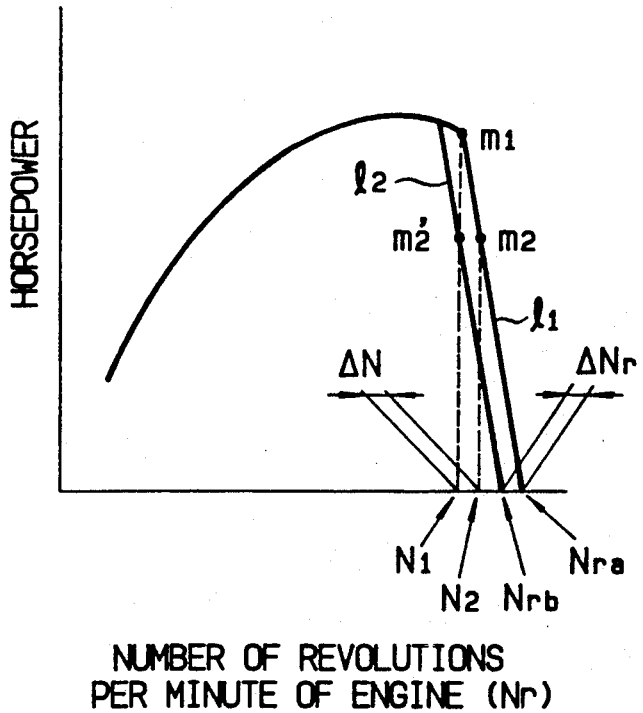
FIG. 5 shows a graph for explaining the function of the above-mentioned embodiment.

Next, when the delivery pressure P reaches or exceeds the Preset cut-off pressure $P_A$, the flow of the fluid discharged by the pump 2 is cut off in accordance with the cut-off characteristics B. As a result, in case the engine 1 has the rated horsepower characteristics as shown in FIG. 5, when the pump 2 is in the equi-horsepower matches with the horsepower developed by the engine 1 at, for example, a point $m_1$, and when the pump is under the cut-off control, a reduction in the flow Q of the fluid discharged by the pump 2 results in a reduction in the horsepower input by the pump, thus moving the matching point down to a point $m_2$ in the same drawing.

The movement of the matching point due to the above-mentioned cut-off will bring about an increase in the number of revolutions of the engine as mentioned hereinbefore. Namely, as the matching point moves from $m_1$ to $m_2$, the number of revolutions of the engine will increase by $\Delta N=N_2-N_1$. Therefore, in case the above-mentioned cut-off control is effected by the increase in the delivery pressure P which occurs when a heavy load operation is made by an implement, an unnatural condition wherein an increase in the number of revolutions of the engine occurs irrespective of the fact that a heavy load operation is made by an implement.

Figure 3:
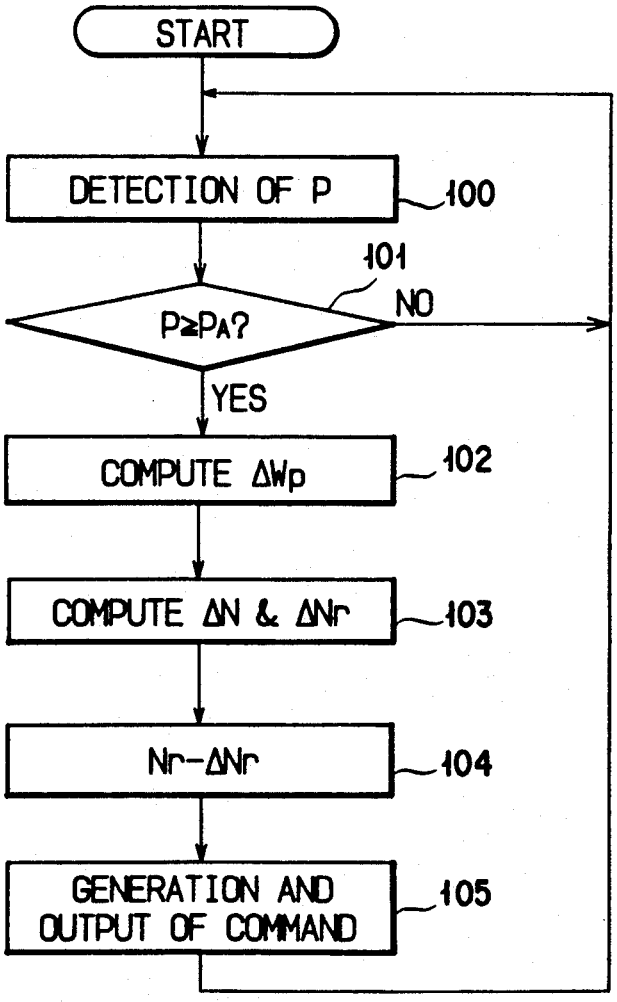
FIG. 3 is a flow chart showing the processing procedure made by a controller shown in FIG. 1.

Accordingly, in this embodiment, arrangement is made such that the controller 10 will execute the steps as shown in FIG. 3.

At these steps, the delivery pressure P of the pump 2 is detected on the basis of the output of the pressure sensor 8 (STEP 100), and then it is judged whether or not the delivery pressure P reaches or exceeds the preset cut-off pressure $P_A$, i.e., whether or not the flow of the fluid discharged by the pump 2 is cut off. (STEP 101).

If it is judged at STEP 101 that the delivery pressure P becomes equal to or more than the preset cut-off pressure $P_A$ ($P\geqq P_A$), then the decrement $\Delta Wp$ in the horsepower input by the hydraulic pump 2 is computed on the basis of the relationship shown in FIG. 4 and the delivery pressure P. (STEP 102)

Figure 6:
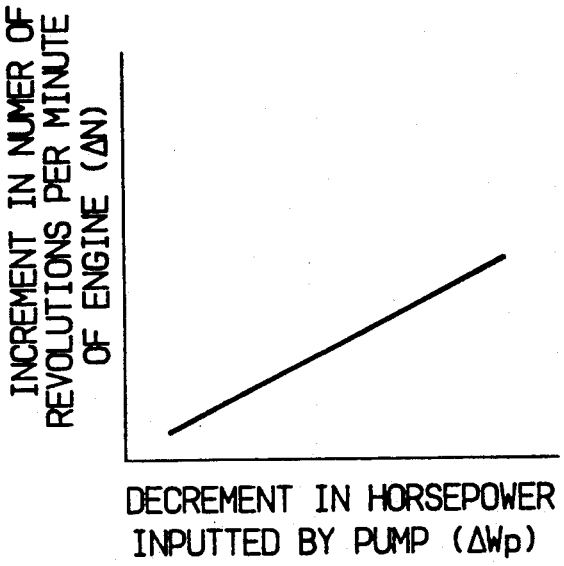
FIG. 6 shows a graph illustrative of the relationship between the decrement in the horsepower input by the pump and the increment in the number of revolutions of the engine.

Whilst, the increment $\Delta N$ in the number of the revolutions of the engine due to a reduction in the horsepower input by the hydraulic pump 2 is determined by the horsepower characteristics developed by the engine. FIG. 6 illustrates the relationship between the decrement in the horsepower input by the hydraulic pump 2 and the increment $\Delta N$ in the number of revolutions of the engine 1.

To prevent the increase in the number of revolutions of the engine, it is only necessary to vary the horsepower characteristics developed by the engine. Namely, in case the horsepower input by the pump 2 is reduced to the magnitude at the point $m_2$, if the horsepower characteristics developed by the engine 1 are changed from $l_1$ to $l_2$, the horsepower input by the pump will match with the horsepower developed by the engine at a point $m_2'$ so that the number of revolutions of the engine can be kept at $N_1$, which is the number of revolutions of the engine before a reduction in the horsepower input by the pump occurs.

The horsepower characteristics developed by the engine 1 are set by the governor 12 on the basis of the target number of revolutions Nr of the engine; that is to say, the manipulated variable of the fuel supply control lever 13 as shown in FIG. 2. The horsepower characteristics $l_1$ shown in FIG. 5 are set by the governor 12 when the target number of revolutions of the engine is Nra, while the horsepower characteristics $l_2$ shown therein are set by the governor 12 when the target number of revolutions of the engine is Nrb.

Figure 7:
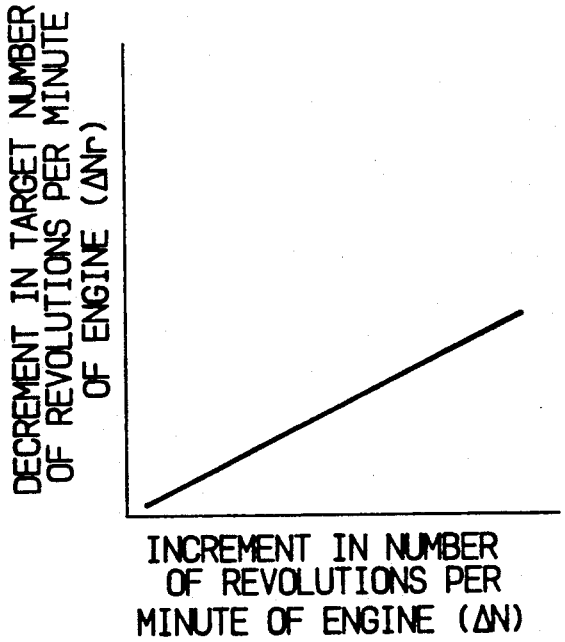
FIG. 7 shows a graph illustrative of the relationship between the increment in a number of revolutions of the engine and the decrement in a target number of revolutions of the engine.

The decrement ΔNr in the target number of revolutions Nr of the engine, which is required to prevent the increase in the number of revolutions of the engine 1 by ΔN can previously be found from the characteristics of the governor 12. This relationship between ΔNr and ΔN is illustrated in FIG. 7. The relationship between ΔNr and ΔN as shown in FIG. 7 and that between ΔN and ΔWp as shown in FIG. 6 are of course stored in the memory 14.

The value of ΔN corresponding to ΔWp is computed by the controller 10 on the basis of the decrement ΔWp in the horsepower input by the pump 2 which is obtained at STEP 102 and the relationship as shown in FIG. 6, and further the value of ΔNr is computed on the basis of the value of ΔN and the relationship as shown in FIG. 7. (STEP 103) And, at the next STEP 104, a step of subtracting ΔNr from the target number of revolutions Nr of the engine as indicated by the accelerator lever 7 is executed. Namely, in case of FIG. 5, a step of subtracting ΔNr from Nra to as to obtain a new target number of revolutions Nrb of the engine is executed.

At STEP 105, a command indicative of a target number of revolutions of the engine corresponding to Nr−ΔNr is generated and output thereby operating the above-mentioned proportional solenoid 11. Thus, the fuel supply control lever 13 shown in FIG. 2 is actuated by the proportional solenoid 11 so that the target number of revolutions of the engine becomes Nr−ΔNr.

As a result, in the case of FIG. 5, the horsepower characteristics of the engine 1 is changed from $l_1$ to $l_2$ thereby keeping the actual number of revolutions of the engine 1 at $N_1$ which is the number of revolutions before the cut-off step.

Thus, according to this embodiment, at the time of the above-mentioned cut-off, the increase in the number of revolutions of the engine due to this cut-off is prevented can be prevented thereby avoiding the inconvenience that the number of revolutions of the engine increases when a heavy load operation is effected.

Although in the above-mentioned embodiment the governor 12 of a mechanical type is used, even in case a so-called electronic type governor is used, the present invention can be applied effectively.

We claim:

1. A hydraulic apparatus for a construction machine wherein at least one variable displacement hydraulic pump driven by an engine is controlled in accordance with equi-horsepower characteristics and with means for determining when the delivery pressure of the pump reaches or exceeds a preset value, control means cuts off the flow of the fluid discharged by the pump wherein means is provided for preventing the number of revolutions of the engine from increasing when the flow of the fluid discharged by the pump is cut off, said means for preventing the number of revolutions from increasing comprising a proportional solenoid connected to a fuel supply control lever of a governor so as to vary the horsepower characteristics of the engine, which are set by the action of the governor based on manipulated variable of the fuel supply control lever, and a controller for controlling the proportional solenoid, the arrangement being such that when the flow of the fluid discharged by the pump is cut off, the controller functions to compute a decrement in a target number of revolutions per minute of the engine, which is obtained by subtracting a target number of revolutions per minute of the engine at desired engine horsepower characteristics from a target number of revolutions per minute of the engine at the initial engine horsepower characteristics, and said proportional solenoid is operated in accordance with this decrement.

* * * * *